US011396637B2

(12) United States Patent
Kim et al.

(10) Patent No.: US 11,396,637 B2
(45) Date of Patent: Jul. 26, 2022

(54) AMINE-FUNCTIONALIZED ORGANOSILANE/ORGANOPHOSPHATE COMBINATION SYSTEMS AS EP AGENTS / CORROSION INHIBITORS IN COMPOSITIONS FOR TREATING METAL SURFACES

(71) Applicant: Chemetall U.S., Inc., New Providence, NJ (US)

(72) Inventors: Hoon Kim, New Providence, NJ (US); Ronald Ascenzo, New Providence, NJ (US)

(73) Assignee: Chemetall U.S., Inc., New Providence, NJ (US)

( * ) Notice: Subject to any disclaimer, the term of this patent is extended or adjusted under 35 U.S.C. 154(b) by 0 days.

(21) Appl. No.: 17/252,986

(22) PCT Filed: Jun. 13, 2019

(86) PCT No.: PCT/US2019/036994

§ 371 (c)(1),
(2) Date: Dec. 16, 2020

(87) PCT Pub. No.: WO2019/245863

PCT Pub. Date: Dec. 26, 2019

(65) Prior Publication Data

US 2021/0115351 A1 Apr. 22, 2021

Related U.S. Application Data

(60) Provisional application No. 62/686,183, filed on Jun. 18, 2018.

(51) Int. Cl.

| | |
|---|---|
| ***C10M 141/12*** | (2006.01) |
| ***C10M 137/04*** | (2006.01) |
| ***C10M 139/04*** | (2006.01) |
| ***C10M 177/00*** | (2006.01) |
| ***C23F 11/167*** | (2006.01) |
| *C10N 40/20* | (2006.01) |
| *C10N 70/00* | (2006.01) |

(52) U.S. Cl.

CPC ..... *C10M 141/12* (2013.01); *C10M 137/04* (2013.01); *C10M 139/04* (2013.01); *C10M 177/00* (2013.01); *C23F 11/1673* (2013.01); *C10M 2223/04* (2013.01); *C10M 2227/04* (2013.01); *C10N 2040/20* (2013.01); *C10N 2070/00* (2013.01)

(58) Field of Classification Search

CPC ..... C23F 11/1673; C10M 139/04; C10M 141/12; C10M 177/00; C10M 137/04; C10M 2227/04; C10M 2223/04; C10M 2229/02; C10N 2030/06; C10N 2030/56; C10N 2070/00; C10N 2040/20

See application file for complete search history.

(56) References Cited

FOREIGN PATENT DOCUMENTS

| | | | |
|---|---|---|---|
| GB | 1473211 | A | 5/1977 |
| JP | 2009001747 | A | 1/2009 |
| WO | 0107679 | A1 | 2/2001 |
| WO | 2011132578 | A1 | 10/2011 |

OTHER PUBLICATIONS

International Search Report and Written Opinion for corresponding PCT/US2019/036994, dated Sep. 23, 2019, 10 pages.

*Primary Examiner* — Vishal N Vasisth

(74) *Attorney, Agent, or Firm* — Armstrong Teasdale LLP

(57) ABSTRACT

A composition treating a metal surface, especially a metal-working fluid, includes the reaction product of at least one amine-functionalized organosilane and at least one organophosphate and/or at least one oligomer or polymer of the reaction product, wherein the molar ratio of the amino group/s of the at least one amine-functionalized and of the at least one organophosphate is 1.0:0.4 to 1.0:1.2, and wherein the at least one amine-functionalized organosilane is linked to the at least one organophosphate by at least one phosphoric acid/amine salt bond. Also described herein is method for producing such a composition, the use of the composition, and a method for treating a metal surface.

15 Claims, No Drawings

AMINE-FUNCTIONALIZED ORGANOSILANE/ORGANOPHOSPHATE COMBINATION SYSTEMS AS EP AGENTS / CORROSION INHIBITORS IN COMPOSITIONS FOR TREATING METAL SURFACES

CROSS-REFERENCE TO RELATED APPLICATIONS

This application is a U.S. National Phase Application of International Patent Application No. PCT/US2019/036994, filed Jun. 13, 2019, which claims the benefit of priority to U.S. Provisional Patent Application No. 62/686,183, filed Jun. 18, 2018, the entire contents of which are hereby incorporated by reference herein.

FIELD OF THE INVENTION

The present invention relates to a composition for treating a metal surface, especially to a metalworking fluid, providing improved high load-carrying extreme pressure performance and corrosion inhibition as well as to a method for producing said composition and a method for treating a metal surface with said composition.

BACKGROUND OF THE INVENTION

The modern metalworking process becomes more and more demanding and complicated, and requires metalworking fluids (MWFs) with enhanced high load-carrying capability, i.e. which function as lubricants under extreme pressure, in other words under high load. Accordingly, significant technical effort and research activity have been devoted to improve lubricity performance of MWFs, especially under high pressure, heavy loading as well as high temperature conditions, i.e. the so called boundary lubrication.

Along these lines, the high load-carrying, i.e. EP (extreme pressure) technology of modern MWFs mainly relies on various chlorinated paraffin, phosphate or sulfide chemistries which form a tribological film on the metal surface by chemical reaction with metals or metal oxides during the metalworking operation. The choice of the specific EP chemistry depends on the severity of metal working operation as well as on the activation temperature of the reaction between EP agents and metal surface (chlorinated paraffins: approx. 180-420° C., phosphates: approx. 200-600° C. and sulfides: >600° C.). At the activation temperature the EP agents begin to form a tribo-film on the metal surface.

Among various EP agents, chlorinated paraffins (CPs) have been the most popular EP additive in MWF formulation due to the numerous advantages including unbeatable cost effectiveness, wide spectrum of activation temperature, versatility in applications, easy formulation and stability in water. But CPs exhibit health and environment issues because of potential toxic release when decomposed. That is why CPs are likely to be banned in the near future by EPA regulation except for very long chain CPs (>C20).

So lately, all MWF manufacturers are seeking CP alternatives, and the majority of them look into various phosphates and sulfur compounds as the potential alternatives. However, phosphorus or sulfur containing compounds have the inherent shortcoming of accumulating excessive nutrients in aqueous systems causing microbial proliferation which in turn has a detrimental effect on MWF performances.

Hence, the development of a new EP chemistry which can minimize microbial growth would be one of the most important topics in founding a new EP technology platform to replace CPs in MWF formulation.

Corrosion inhibition is also an important issue in the field of MWFs, as metal surfaces tend to be corroded in an aqueous environment and the majority of modern MWFs mainly consist of water. Therefore, it would be very advantageous, if the EP agents also exhibited corrosion inhibiting properties.

As will be explained hereinafter, the present invention describes the use of amine-functionalized organosilanes reacted with organophosphates as new CP-free EP and corrosion inhibiting technology with minimum level of phosphorus content—in compositions for treating metal surfaces, particularly in semi-synthetic MWF formulations.

BRIEF DESCRIPTION OF THE INVENTION

According to the present invention, the composition for treating a metal surface, especially a metalworking fluid, comprises the reaction product of at least one amine-functionalized organosilane and at least one organophosphate and/or at least one oligomer or polymer of said reaction product, wherein the molar ratio of the amino group/s of the at least one amine-functionalized and of the at least one organophosphate is in the range of 1.0:0.4 to 1.0:1.2, and wherein the at least one amine-functionalized organosilane is linked to the at least one organophosphate by at least one phosphoric acid/amine salt bond.

Alkoxysilane and phosphate functional groups react with the treated metal surface and the non-polar hydrocarbon chain of the phosphate linked to the organosilane through salt formation functions as barrier to prevent water, oxygen and corrosive chemicals from accessing the metal surface.

Moreover, the hydrophobic nature of the hydrocarbon chain also suppresses undesirable gel formation of alkoxysilane groups by preventing excess hydrolysis and subsequent condensation. The obtained barrier thickness can be controlled by varying the hydrocarbon chain length and structure.

The enhanced high load-carrying capacity between the metal/metal interface, in particular during a metalworking process, is achieved through combinative action of a) organophosphate functional groups reacting with the metal surface under high pressure/high temperature conditions and b) aminoalkyl silane functional groups anchoring onto the metal/metal oxide surface via charge transfer interactions.

DETAILED DESCRIPTION OF THE PREFERRED EMBODIMENTS

The following paragraphs describe preferred embodiments of the composition according to the present invention.

The term "composition for treating a metal surface" in the sense of the present invention not only comprises metalworking fluids. For example, it also refers to lubricants, e.g. dry lubes, rust preventives, cleaners and compositions for permanent coating of metal surfaces. Nevertheless, the use of the composition according to the invention as metalworking fluid is especially preferred.

The "metal surface" to be treated preferably comprises aluminum, an aluminum alloy, steel and/or galvanized steel. At that, preferred aluminium alloys contain Cu, Si, Mg and/or Zn and the galvanized steel may be hot-dipped or electrolytically galvanized steel. More preferably, the "metal surface" comprises a mix of different metals, e.g. areas of aluminum/an aluminum alloy as well as areas of (galvanized) steel, since the present technology is especially suitable for such multi-metal surfaces.

The "metal surface" may also be a metal surface coated with a conversion or passivation layer. Preferably, however, it is not coated with a conversion or passivation layer.

In the present invention the term "amine-functionalized organosilane" stands for an amine-functionalized organosilane and/or oligomer and/or polymer thereof, which may originate from the partial hydrolysis of the amine-functionalized organosilane and the subsequent (partial) condensation of the hydrolysis product, i.e. the corresponding organosilanol, respectively. The water for said hydrolysis may be released as a by-product during the reaction of the at least one amine-functionalized organosilane and the at least one organophosphate, i.e. during phosphoramide bond formation, and/or may be a contaminant in the educts used.

In the present invention the term "organophosphate" stands for all protonated and deprotonated forms of such an organophosphate.

The at least one amine-functionalized organosilane may be a single organosilane or a mixture of two or more different organosilanes.

The at least one amine-functionalized organosilane has at least one hydrocarbyl moiety, which carries at least one amino group. As amino group/s primary —$NH_2$ is preferred. The organosilane preferably has one hydrocarbyl moiety carrying one amino group. However, it may also have two or more hydrocarbyl moieties carrying one or two or more amino groups.

As hydrocarbyl moiety/ies alkyl is preferred, more preferably alkyl having three or more carbon atoms. According to one embodiment, at least one amine-functionalized organosilane having two or more alkyl groups and/or branched alkyl groups may be used being more stable in terms of hydrolysis. However, the adhesion of such organosilanes to the treated metal surface is lower.

Beside the at least one hydrocarbyl moiety, the at least one amine-functionalized organosilane preferably has one or more hydrocarbyloxy moiety, wherein the sum of the hydrocarbyl and the hydrocarbyloxy moieties is preferably four, i.e. there is/are no other moiety/ies at the central silicon atom of the organosilane. As hydrocarbyloxy moiety/ies alkyloxy is preferred.

However, the at least one amine-functionalized organosilane may also have one or more —OH groups instead of the one or more hydrocarbyloxy group.

Especially preferably the at least one amine-functionalized organosilane comprises at least one aminoalkyl trialkoxysilane and most preferably 3-aminopropyl triethoxysilane.

The at least one organophosphate may be a single organophosphate or a mixture of two or more different organophosphates.

Each organophosphate molecule has one or two hydrocarbon chains attached to the central phosphate atom via a phosphoric acid ester bond (C—O—P).

The hydrocarbon chain/s may be interrupted by at least one heteroatom, especially by nitrogen, oxygen and/or sulfur, preferably by oxygen. Moreover, the hydrocarbon chain/s may contain at least one aromatic or heteroaromatic moiety, especially a phenylene moiety.

The overall hydrophobic nature of long hydrocarbon chains suppresses undesirable gel formation within the composition by preventing excess hydrolysis and subsequent condensation. Said hydrocarbon chains repel water and, thus, reduce the chance of water contact to the amine-functionalized organosilane.

For the use of the composition as a metal working fluid, the hydrocarbon chain/s preferably has/have 8 to 22 carbon atoms.

According to an embodiment, the at least organophosphate has at least one branched hydrocarbon chain, preferably with at least one side chain having at least 2 carbon atoms and more preferably with at least on side chain having at least 4 carbon atoms. Such branched hydrocarbon chains are advantageous, if the metal surface is treated with an amine-functionalized organosilane and/or oligomer and/or polymer thereof having a large polar head group, e.g. 3-triethoxysilyl-propylamino-.

The adhesion of the at least one organophosphate to a metal surface comprising aluminum, an aluminum, steel and/or galvanized steel may be enhanced by introducing at least one C═C double bond into the at least one hydrocarbon chain, as there is an attraction between C═C double bonds and the according metal.

Hence, the at least one organophosphate preferably has at least one hydrocarbon chain exhibiting at least one C═C double bond, more preferably at least one C═C double bond in cis configuration, as the latter is expected to especially enhance the adsorption to an aluminum containing surface.

The properties of the composition according to the invention as well as of the resulting barrier layer may be tailored for the intended application by using a mixture of at least two organophosphates with different hydrocarbon chains (number of carbon atoms, hydrophobicity/hydrophilicity, unbranched/branched, saturated/unsaturated) as the at least one organophosphate.

Preferably, the at least one organophosphate comprises at least one organophosphate which exhibits the following structure:

$$O{=}P(OR)_2{-}OH \qquad (I),$$

wherein every of the two R moieties may be H, $X{-}(OCH_2CH_2)_n{-}$ or $X_m$Ph-$(OCH_2CH_2)_n{-}$ with the proviso that at least one of the R moieties is $X{-}(OCH_2CH_2)_n{-}$ or $X_m$Ph-$(OCH_2CH_2)_n{-}$, wherein X is a linear alkyl chain, which may be interrupted by one or two C═C bonds and which has 6 to 22 carbon atoms, and wherein m is an integer of from 1 to 3 and n is an integer in the range of from 0 to 12.

Preferably, m is 1 or 2, n is an integer in the range of from 0 to 9 and X has 8 to 18 carbon atoms.

According to a first especially preferred embodiment, the composition according to the invention is produced by applying at least one organophosphate according to the above formula (I), wherein every of the two R moieties may be H or $X{-}(OCH_2CH_2)_n{-}$ with the proviso that at least one of the R moieties is $X{-}(OCH_2CH_2)_n{-}$, wherein X is a linear alkyl chain, which is interrupted by one or two C═C bonds and which has 6 to 22 carbon atoms, and wherein n is an integer in the range of from 1 to 12.

In addition to its EP agent function, the resulting reaction product can be a multifunctional additive as emulsifier/surfactant by controlling the n numbers. As described above, C═C enhances the adhesion to a metal surface comprising aluminum, an aluminum, steel and/or galvanized steel. X protects the surface from corrosive agents, i.e. functions as a corrosion inhibitor, whereas, the phosphorus containing head group improves lubricity as EP agent.

It is further preferred, that one of the three R moieties is $X{-}(OCH_2CH_2)_n{-}$ and the other two R moieties are H, wherein X is a linear alkyl chain, which is interrupted by one or two C═C bonds and which has 6 to 22 carbon atoms, and wherein n is an integer in the range of from 1 to 12.

It is also further preferred, that every of the two R moieties may be H or X—$(OCH_2CH_2)_n$— with the proviso that at least one of the R moieties is X—$(OCH_2CH_2)_n$—, wherein X is a linear alkyl chain, which is interrupted by one C═C bond and which has 14 to 20 carbon atoms, and wherein n is an integer in the range of from 1 to 5.

It is even more preferred, that one of the two R moieties is X—$(OCH_2CH_2)_n$— and the other one is H, wherein X is a linear alkyl chain, which is interrupted by one C═C bond and which has 14 to 20 carbon atoms, and wherein n is an integer in the range of from 1 to 5.

An especially preferred example of an organophosphate according to this first preferred embodiment is:

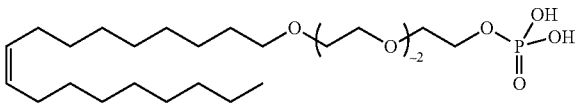

This organophosphate is preferably reacted with 3-aminopropyltrimethoxysilane or 3-aminopropyltriethoxysilane, in particular with 3-aminopropyltriethoxysilane.

According to a second especially preferred embodiment, the composition according to the invention is produced by applying at least one organophosphate according to the above formula (I), wherein every of the two R moieties may be H or X—$(OCH_2CH_2)_n$— with the proviso that at least one of the R moieties is X—$(OCH_2CH_2)_n$—, wherein X is a linear alkyl chain, which is not interrupted by a C═C bond and has 6 to 22 carbon atoms, and wherein n is an integer in the range of from 1 to 12.

The absence of C═C improves the oxidation stability of the resulting reaction product.

It is further preferred, that one of the two R moieties is X—$(OCH_2CH_2)_n$— and the other one is H, wherein X is a linear alkyl chain, which has 6 to 22 carbon atoms, and wherein n is an integer in the range of from 1 to 12.

It is also further preferred, that every of the two R moieties may be H or X—$(OCH_2CH_2)_n$— with the proviso that at least one of the R moieties is X—$(OCH_2CH_2)_n$—, wherein X is a linear alkyl chain, which has 8 to 16 carbon atoms, and wherein n is an integer in the range of from 1 to 8.

It is even more preferred, that one of the two R moieties is X—$(OCH_2CH_2)_n$— and the other one is H, wherein X is a linear alkyl chain, which has 8 to 16 carbon atoms, and wherein n is an integer in the range of from 1 to 8.

An especially preferred example of an organophosphate according to this second preferred embodiment is:

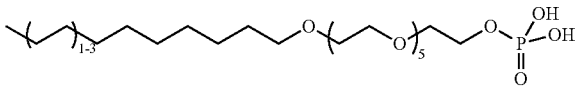

This organophosphate is preferably reacted with 3-aminopropyltrimethoxysilane or 3-aminopropyltriethoxysilane, in particular with 3-aminopropyltriethoxysilane.

According to a third especially preferred embodiment, the composition according to the invention is produced by applying at least one organophosphate according to the above formula (I), wherein every of the two R moieties may be H or X— with the proviso that at least one of the R moieties is X—, wherein X is a linear alkyl chain, which has 6 to 22 carbon atoms.

It is further preferred, that both R moieties are X—, wherein X is a linear alkyl chain, which has 6 to 22 carbon atoms.

Due to its branched structure, the resulting reaction product exhibits the best oxidation stability, excellent anti-corrosion/stain performance, minimal pH change and better microbial control as well.

It is also further preferred, that that every of the two R moieties may be H or X— with the proviso that at least one of the R moieties is X—, wherein X is a linear alkyl chain, which has 8 to 12 carbon atoms.

It is even more preferred, that both R moieties are X—, wherein X is a linear alkyl chain, which has 8 to 12 carbon atoms.

An especially preferred example of an organophosphate according to this third preferred embodiment is:

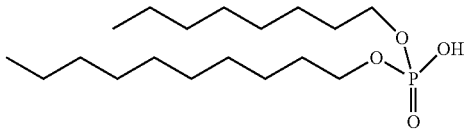

This organophosphate is preferably reacted with 3-aminopropyltrimethoxysilane or 3-aminopropyltriethoxysilane, in particular with 3-aminopropyltriethoxysilane.

According to a fourth especially preferred embodiment, the composition according to the invention is produced by applying at least one organophosphate according to the above formula (I), wherein every of the two R moieties may be H or $X_m$Ph-$(OCH_2CH_2)_n$— with the proviso that at least one of the R moieties is $X_m$Ph-$(OCH_2CH_2)_n$—, wherein X is a linear alkyl chain which has 6 to 22 carbon atoms, and wherein m is an integer of from 1 to 3 and n is an integer in the range of from 1 to 12.

The resulting reaction product exhibits better emulsion as well as microbial control.

It is further preferred, that one of the two R moieties is $X_m$Ph-$(OCH_2CH_2)_n$— and the other one is H, wherein X is a linear alkyl chain which has 6 to 22 carbon atoms, and wherein m is an integer of from 1 to 3 and n is an integer in the range of from 1 to 12.

It is also further preferred, that every of the two R moieties may be H or $X_m$Ph-$(OCH_2CH_2)_n$— with the proviso that at least one of the R moieties is $X_m$Ph-$(OCH_2CH_2)_n$—, wherein X is a linear alkyl chain which has 7 to 13 carbon atoms, and wherein m is 1 or 2 and n is an integer in the range of from 2 to 11.

It is even more preferred, that one of the two R moieties is $X_m$Ph-$(OCH_2CH_2)_n$— and the other one is H, wherein X is a linear alkyl chain which has 7 to 13 carbon atoms, and wherein m is 1 or 2 and n is an integer in the range of from 2 to 11.

Especially preferred examples of an organophosphate according to this fourth preferred embodiment are:

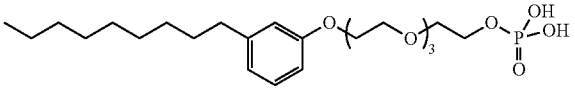

-continued

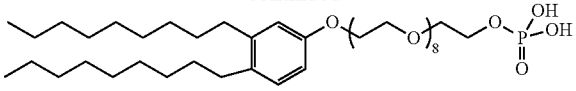

These organophosphates are preferably reacted with 3-aminopropyltrimethoxysilane or 3-aminopropyltriethoxysilane, in particular with 3-aminopropyltriethoxysilane.

The thickness and density as well as the adsorption of the barrier layer on the treated metal surface depend on the length and structure of the hydrocarbon chain/s of the applied at least one organophosphate as well as on the structure of the used at least one amine-functionalized organosilane. Branched tails lead to films being less dense and less thick but exhibiting strong adsorption, whereas long, linear tails result in films having higher density and thickness at the cost of some adsorption strength. A large head group originating from the organosilane results in films having lower density and thickness but with strong adsorption, whereas a small head group leads to films being denser and thicker accompanied with some loss in adsorption strength.

In the composition according to the invention the molar ratio of the amino group/s of the at least one amine-functionalized organosilane and/or oligomer and/or polymer thereof and of the at least one organophosphate is preferably in the range of 1.0:0.4 to 1.0:0.6 or in the range of 1:0:0.8 to 1.0:1.2.

The composition according to the invention may be prepared by diluting a suitable concentrate, preferably by a factor of 1:10 to 1:20 (corresponding to 5 to 10 wt-% of concentrate), with a suitable solvent, preferably deionized water, and—if necessary—subsequently adjusting the pH value with a suitable pH modifying agent.

In such a concentrate, the at least one amine-functionalized organosilane is preferably comprised in a concentration of 0.1 to 4.0 wt-%, more preferably 0.2 to 2.0 wt-% and especially preferably 0.6 to 1.5 wt-% (calculated as educt), and the at least one organophosphate is preferably comprised in a concentration of 0.1 to 4.0 wt-%, more preferably 0.3 to 3.0 wt.-% and especially preferably 1.0 to 2.0 wt-% (calculated as educt).

Correspondingly, in the composition according to the invention obtainable by dilution of said concentrate, the at least one amine-functionalized organosilane is preferably comprised in a concentration of 0.005 to 0.4 wt-%, more preferably 0.01 to 0.2 wt-% and especially preferably 0.03 to 0.15 wt-% (calculated as educt), and the at least one organophosphate is preferably comprised in a concentration of 0.005 to 0.4 wt-%, more preferably 0.015 to 0.3 wt-% and especially preferably 0.05 to 0.2 wt-% (calculated as educt).

Preferably, the concentrate mentioned above additionally comprises:

10 to 40 wt-% of naphthenic oil,
4 to 7 wt-% of polymerized ricinoleic acid,
3 to 6 wt-% of a self-emulsifying ester,
2 to 4 wt-% of a polymeric complex ester,
3 to 6 wt-% of a maleated polymeric ester,
2 to 4 wt-% of eurucic acid,
3 to 6 wt-% of diethylethanol amine,
2 to 4 wt-% of diglycol amine,
1 to 2 wt-% of tri-propylene glycol butyl ether,
1 to 3 wt-% of 3-amino-4-octanol,
20 to 40 wt-% of deionized water,
2 to 4 wt-% of triethanol amine,
4 to 8 wt-% of an approximately 1:1 molar ratio mixture of dodecanedioic acid and triethanol amine,
1 to 2 wt-% of secondary alcohol ethoxylate as a non-ionic surfactant,
0.5 to 1.5 wt-% of a dicarboxy fatty acid,
2 to 4 wt-% of the reaction product of (3-aminopropyl) triethoxysilane and eurucic acid (1:1 molar ratio) and/or
to 0.5 wt-% of a defoamer mixture
(with the proviso, that all components sum up to 100 wt-%).

According to an especially preferred embodiment, the concentrate additionally comprises all of the components mentioned before in the wt-% ranges mentioned before.

Accordingly, the composition according to the invention additionally comprises:

0.5 to 4 wt-% of naphthenic oil,
to 0.7 wt-% of polymerized ricinoleic acid,
0.15 to 0.6 wt-% of a self-emulsifying ester,
to 0.4 wt-% of a polymeric complex ester,
0.15 to 0.6 wt-% of a maleated polymeric ester,
to 0.4 wt-% of eurucic acid,
0.15 to 0.6 wt-% of diethylethanol amine,
to 0.4 wt-% of diglycol amine,
0.05 to 0.2 wt-% of tri-propylene glycol butyl ether,
0.05 to 0.3 wt-% of 3-amino-4-octanol,
91 to 95 wt-% of deionized water,
to 0.4 wt-% of triethanol amine,
to 0.8 wt-% of an approximately 1:1 molar ratio mixture of dodecanedioic acid and triethanol amine,
0.05 to 0.2 wt-% of secondary alcohol ethoxylate as a non-ionic surfactant,
0.025 to 0.15 wt-% of a dicarboxy fatty acid,
to 0.4 wt-% of the reaction product of (3-aminopropyl) triethoxysilane and eurucic acid (1:1 molar ratio) and/or
0.005 to 0.05 wt-% of a defoamer mixture
(with the proviso, that all components sum up to 100 wt-%).

According to an especially preferred embodiment, the composition according to the invention additionally comprises all of the components mentioned before in the wt-% ranges mentioned before.

According to a preferred embodiment, the composition is an aqueous composition, which means, that more than 50 wt-% of the solvent/s is water, e.g. when the concentrate is predominantly diluted with water as a solvent. The composition may also comprise a synthetic oil and/or a mineral oil as a solvent, e.g. naphthenic oil. Due to the additional use of such an oil, the composition has the advantage of combining good lubricity with high cooling capacity.

Depending on the intended metal surface treatment, the properties of the composition according to the invention may be tailored by adding different kinds of additives.

In detail said additives may be neutralizers, emulsifiers, lubricity enhancers, biocides, fungicides, metal deactivators and/or stability enhancers for freeze/thaw cycles.

Further on, the additives may serve for anti-corrosion, pH-control, coupling, wetting, microbial control and/or against foam formation.

The pH value of the composition preferably lies in the range of 8.5 to 10.5, more preferably in the range of 9.0 to 10.0 and especially preferably in the range of 9.2 to 9.7.

The present invention also includes a method for producing a composition according to the invention. In this process i) at least one amine-functionalized organosilane (referring to the amino group/s) and at least one organophosphate are mixed in a molar ratio in the range of 1.0:0.4 to 1.0:1.2 in a neat reaction or in at least one organic solvent, ii) under stirring the mixture is subjected for at least 35 minutes to a temperature of at least 10° C., iii) in case of steps i) and ii) being conducted in at least one organic solvent, the reaction product is isolated as a viscous liquid, and iv) the reaction product is then combined with other components, so that a composition for treating a metal surface or a concentrate of such a composition is obtained, wherein the mixture resulting from step i) is essentially water-free.

At that, "essentially water-free" means that water may be contained as contaminant in the mixture of step i) resulting from an according contamination of the educts and/or the solvents used. At that, the water is not added intentionally and is, thus, preferably contained in the mixture of step i) in a concentration of not more than 0.1 wt-%.

If water is contained as contaminant in the mixture of step i), oligomeric and/or polymeric species are formed to a certain extent by partial hydrolysis of the alkoxysilane groups and subsequent condensation reactions of the resulting silanol groups to siloxane groups. However, also the water being released as a by-product during phosphoramide bond formation in step ii) may cause partial hydrolysis and subsequent condensation reactions leading to oligomeric and/or polymeric species.

Steps i) and ii) are preferably conducted without using any solvents, i.e. in a neat reaction. Step iii) is then obsolete. However, it is also possible to use essentially water-free organic solvents like e.g. base oil to prepare the mixture in step i). In this case, the reaction time required in step ii) would be longer, whereas, the exothermicity of the reaction may be controlled better, which can be advantageous especially for large scale production.

In step ii) the at least one amine-functionalized organosilane and the at least one organophosphate are linked through typical acid/base reactions in the absence of any catalysts, i.e. by at least one phosphoric acid/amine salt bond. However, phosphoramide bond formation may occur as well.

Step ii) is preferably conducted at a temperature in the range of 20 to 55° C., especially preferably at room temperature. The reaction time required in step ii) is preferably in the range of 40 to 50 minutes.

It is preferred, that the composition according to the invention contains at least one oligomer or polymer of the reaction product of at least one amine-functionalized organosilane and at least one organophosphate. This is especially advantageous, because such oligomeric/polymeric products will enhance the emulsion stability.

In step iv) the reaction product is preferably combined with other components, so that a concentrate of a composition for treating a metal surface is obtained which is then diluted to such a composition.

Moreover, the invention also comprises a method for treating a metal surface, wherein the metal surface is brought into contact with a composition according to the invention and is then optionally rinsed.

The metal surface may also be cleaned and/or rinsed before it is brought into contact with a composition according to the invention.

Preferably, the metal surface is a multi-metal surface and is brought into contact with a composition according to the invention which is a metal working fluid, and then a metalworking process is performed under extreme pressure/high load conditions. At that, the metal surface preferably comprises aluminum and/or an aluminum alloy as well as steel and/or galvanized steel.

The composition according to the invention is preferably used as a metalworking fluid, as a lubricant, in particular as a dry lube, as a rust preventive, as a cleaner and/or for the permanent coating of metal surfaces. More preferably, the composition is used as a metalworking fluid.

The present invention should be pointed out by the following examples without thereby limiting the scope of the invention.

COMPARATIVE EXAMPLES

Comparative Example 1 (CE1)

A concentrate of a metalworking fluid containing 30 wt-% of naphthenic oil, 20.5 wt-% of deionized water, 8 wt-% of 2-amino-2-methyl-propanol, 4 wt-% of boric acid, 7 wt-% of an approximately 1:1 molar ratio mixture of dodecanedioic acid and triethanol amine, 1 wt-% of secondary alcohol ethoxylate as a non-ionic surfactant, 3 wt-% of branched succinic acid, 1 wt-% of tallow amine ethoxylate, 0.5 wt-% of a dicarboxy fatty acid, 0.3 wt.-% of di-propylene glycol butyl ether, 8 wt-% of chlorinated fatty acid, 0.5 wt-% of 3-iodo-2-propynyl butyl carbamate, 2 wt-% of oleyl alcohol, 14 wt-% of medium chain length chlorinated paraffin and 0.2 wt-% of a defoamer mixture (with the proviso, that all components sum up to 100 wt-%) was produced by mixing said components.

Comparative Example 2 (CE2)

A concentrate of a metalworking fluid containing 23 wt-% of naphthenic oil, 6 wt-% of polymerized ricinoleic acid, 4 wt-% of a self-emulsifying ester, 3 wt-% of a polymeric complex ester, 4 wt-% of a maleated polymeric ester, 3 wt-% of eurucic acid, 5 wt-% of diethylethanol amine, 3 wt.-% of diglycol amine, 2 wt-% of tri-propylene glycol butyl ether, 2 wt-% of 3-amino-4-octanol, 30 wt-% of deionized water, 3 wt-% of triethanol amine, 6 wt-% of an approximately 1:1 molar ratio mixture of dodecanedioic acid and triethanol amine, 1.5 wt-% of secondary alcohol ethoxylate as a non-ionic surfactant, 1 wt-% of a dicarboxy fatty acid, 3 wt-% of the reaction product of (3-aminopropyl)triethoxysilane and eurucic acid (1:1 molar ratio) and 0.5 wt.-% of a defoamer mixture (with the proviso, that all components sum up to 100 wt-%) was produced by mixing said components.

Example 1 (E1)

A concentrate of a metalworking fluid containing 22.2 wt-% of naphthenic oil, 5 wt-% of polymerized ricinoleic acid, 4 wt-% of a self-emulsifying ester, 2.5 wt-% of a polymeric complex ester, 4 wt-% of a maleated polymeric ester, 3 wt-% of eurucic acid, 5 wt-% of diethylethanol amine, 2.5 wt-% of diglycol amine, 2 wt-% of tri-propylene glycol butyl ether, 2 wt-% of 3-amino-4-octanol, 30 wt-% of deionized water, 3 wt-% of triethanol amine, 6 wt-% of an approximately 1:1 molar ratio mixture of dodecanedioic acid and triethanol amine, 1.5 wt-% of secondary alcohol ethoxylate as a non-ionic surfactant, 1 wt-% of a dicarboxy fatty acid, 3 wt-% of the reaction product of (3-aminopropyl) triethoxysilane and phosphoric acid decyl octyl ester (1:1 molar ratio), 3 wt-% of the reaction product of (3-aminopropyl)triethoxysilane and eurucic acid (1:1 molar ratio) and 0.3 wt-% of a defoamer mixture (with the proviso, that all components sum up to 100 wt-%) was produced by mixing said components.

At that, the reaction product of (3-aminopropyl)triethoxysilane and phosphoric acid decyl octyl ester (1:1 molar ratio) had been prepared by the following procedure:

The (3-aminopropyl)triethoxysilane and the phosphoric acid decyl octyl ester were mixed in a molar ratio of 1:1 in a neat reaction without using any solvents.

Then under stirring the mixture was subjected for 40 to 50 minutes to room temperature.

8 parts by volume of concentrate CE1, CE2 or E1 were added to 92 parts by volume of hard water (75 ppm of calcium acetate in DI water) and mixed. The obtained metalworking fluids CE1, CE2 and E1 were applied to 1018 steel (CRS) test plates as well as to 6061 aluminum test plates by using disposable pipettes.

In order to measure the torque force, a Micro Tap Test was performed by means of a thread tapping device. The obtained results are shown in the following Tab. 1:

TABLE 1

| (Comparative) Example | test plate | torque in Ncm |
|---|---|---|
| CE1 | steel | 174.0 |
| | aluminum | 176.3 |
| CE2 | steel | 212.0 |
| | aluminum | 167.3 |
| E1 | steel | 171.6 |
| | aluminum | 109.0 |

As one can clearly see, in contrast to CE2, the metalworking fluid containing the reaction product of (3-aminopropyl)triethoxysilane and phosphoric acid decyl octyl ester (1:1 molar ratio) (E1) leads to torque values on steel as well as on aluminum which are even superior to, i.e. lower than, the values obtained with the metalworking fluid containing chlorinated paraffin and chlorinated fatty acid (CE1, state of the art).

The invention claimed is:

1. A composition for treating a metal surface, the composition comprising a reaction product of at least one amine-functionalized organosilane and at least one organophosphate and/or at least one oligomer or polymer of the reaction product, wherein the molar ratio of the amino group/s of the at least one amine-functionalized organosilane and of the at least one organophosphate is in the range of 1.0:0.4 to 1.0:1.2, wherein the at least one amine-functionalized organosilane is linked to the at least one organophosphate by at least one phosphoric acid/amine salt bond;

wherein the at least one organophosphate comprises at least one organophosphate having a structure $$O{=}P(OR)_2{-}OH \qquad \text{(formula I)}$$

wherein each of the two R moeities may independently be H, $X{-}(OCH_2CH_2)n{-}$, or $X_mPh{-}(OCH_2CH_2)n{-}$, wherein at least one of the R moeities is $X{-}(OCH_2CH_2)n{-}$ or $X_mPh{-}(OCH_2CH_2)n{-}$;

wherein X is a linear alkyl chain that may be interrupted by one or two C=C bonds and that has 6 to 22 carbon atoms; and, wherein m is an integer of from 1 to 3 and n is an integer in the range of from 0 to 12.

2. The composition according to claim 1 characterized in that the at least one amine-functionalized organosilane comprises at least one aminoalkyl trialkoxysilane.

3. The composition according to claim 1 characterized in that the at least one organophosphate has at least one hydrocarbon chain exhibiting at least one C=C double bond.

4. The composition according to claim 1 characterized in that the at least one organophosphate comprises at least one organophosphate according to formula (I), wherein every of the two R moieties may be H or $X{-}(OCH_2CH_2)_n{-}$ with the proviso that at least one of the R moieties is $X{-}(OCH_2CH_2)_n{-}$, wherein X is a linear alkyl chain, which is interrupted by one or two C=C bonds and which has 6 to 22 carbon atoms, and wherein n is an integer in the range of from 1 to 12.

5. The composition according to claim 1 characterized in that the at least one organophosphate comprises at least one organophosphate according to formula (I), wherein every of the two R moieties may be H or $X{-}(OCH_2CH_2)_n{-}$ with the proviso that at least one of the R moieties is $X{-}(OCH_2CH_2)_n{-}$, wherein X is a linear alkyl chain, which is not interrupted by a C=C bond and has 6 to 22 carbon atoms, and wherein n is an integer in the range of from 1 to 12.

6. The composition according to claim 1 characterized in that the at least one organophosphate comprises at least one organophosphate according to formula (I), wherein every of the two R moieties may be H or X— with the proviso that at least one of the R moieties is X—, wherein X is a linear alkyl chain, which has 6 to 22 carbon atoms.

7. The composition according to claim 6 characterized in that both R moieties are X—, wherein X is a linear alkyl chain, which has 6 to 22 carbon atoms.

8. The composition according to claim 6 characterized in that every of the two R moieties may be H or X— with the proviso that at least one of the R moieties is X—, wherein X is a linear alkyl chain, which has 8 to 12 carbon atoms.

9. The composition according to claim 1 characterized in that the at least one organophosphate comprises at least one organophosphate according to formula (I), wherein every of the two R moieties may be H or $X_mPh{-}(OCH_2CH_2)_n{-}$ with the proviso that at least one of the R moieties is $X_mPh{-}(OCH_2CH_2)_n{-}$, wherein X is a linear alkyl chain which has 6 to 22 carbon atoms, and wherein m is an integer of from 1 to 3 and n is an integer in the range of from 1 to 12.

10. The composition according to claim 1 characterized in that the composition contains at least one oligomer or polymer of the reaction product of the at least one amine-functionalized organosilane and the at least one organophosphate.

11. A concentrate characterized in that the composition according to claim 1 is obtainable by diluting said concentrate and optionally adjusting the pH value.

12. A method for producing a composition according claim 1, the method comprising:

i) mixing at least one amine-functionalized organosilane and at least one organophosphate in a molar ratio in the range of 1.0:0.4 to 1.0:1.2 in a neat reaction or in at least one organic solvent, ii) under stirring, subjecting the mixture for at least 35 minutes to a temperature of at least 10° C., iii) in case of steps i) and ii) being conducted in at least one organic solvent, isolating the reaction product as a viscous liquid, and iv) combining the reaction product with other components, to obtain a composition for treating a metal surface or a concentrate of such a composition, wherein the mixture resulting from step i) is essentially water-free.

13. A method for treating a metal surface, the method comprising contacting the metal surface with a composition according to claim 1.

14. A method of using the composition according to claim 1, the method comprising using the composition as a metalworking fluid, as a lubricant, as a dry lube, as a rust preventive, as a cleaner and/or for the permanent coating of metal surfaces.

15. The composition according to claim 3 characterized in that the at least one organophosphate has at least one C═C double bond in cis configuration.

* * * * *